US006081971A

United States Patent [19]

Leder et al.

[11] Patent Number: 6,081,971

[45] Date of Patent: Jul. 4, 2000

[54] DEVICE FOR A TRAVELING FLATS ASSEMBLY IN A CARDING MACHINE

[75] Inventors: Armin Leder; Ralf Meger, both of Mönchengladbach, Germany

[73] Assignee: Trützschler GmbH & Co. KG, Mönchengladbach, Germany

[21] Appl. No.: 09/326,654

[22] Filed: Jun. 7, 1999

[30] Foreign Application Priority Data

Jun. 5, 1998 [DE] Germany ..... 198 25 316

[51] Int. Cl.[7] ..... D01G 15/02

[52] U.S. Cl. ..... 19/102; 19/103

[58] Field of Search ..... 19/98, 99, 102, 19/103, 104, 110, 111, 112, 113, 114

[56] References Cited

U.S. PATENT DOCUMENTS

| | | | |
|---|---|---|---|
| 5,271,125 | 12/1993 | Leifeld et al. | 19/103 |
| 5,398,381 | 3/1995 | Schlichter et al. | 19/102 |
| 5,473,795 | 12/1995 | Spix et al. | 19/113 |
| 5,745,955 | 5/1998 | Patelli et al. | 19/102 |
| 5,918,349 | 7/1999 | Leifeld et al. | 19/103 |
| 5,974,629 | 11/1999 | Leifeld et al. | 19/98 |

*Primary Examiner*—Michael A. Neas
*Assistant Examiner*—Gary L. Welch
*Attorney, Agent, or Firm*—Venable; Gabor J. Kelemen

[57] ABSTRACT

A traveling flats assembly of a carding machine includes first and second end sprockets; an endless belt supported by the first and second end sprockets; a plurality of flat bars arranged in a series along the belt; a coupling arrangement for connecting the flat bars to the belt for being carried by the lower belt flight through a working zone in which the flat bars cooperate with the main carding cylinder of the carding machine and for being carried by the upper belt flight through a return zone; a supporting component having an arcuate supporting surface; a first concave slide guide extending parallel to one part of a circumference of the first end sprocket for guiding and holding the flat bars as they travel about the first end sprocket; a second concave slide guide extending parallel to one part of a circumference of the second end sprocket for guiding and holding the flat bars as they travel about the second end sprocket; and a convex slide guide extending through the work zone and lying on the supporting surface of the supporting component. The convex slide guide has an upper surface on which the flat bars glide. The convex slide guide is longitudinally shiftable relative to the supporting component. The first and second concave slide guides and the convex slide guide are mutually separate components and the convex slide guide has opposite first and second terminal portions passing through respective first and second concave slide guides.

15 Claims, 8 Drawing Sheets

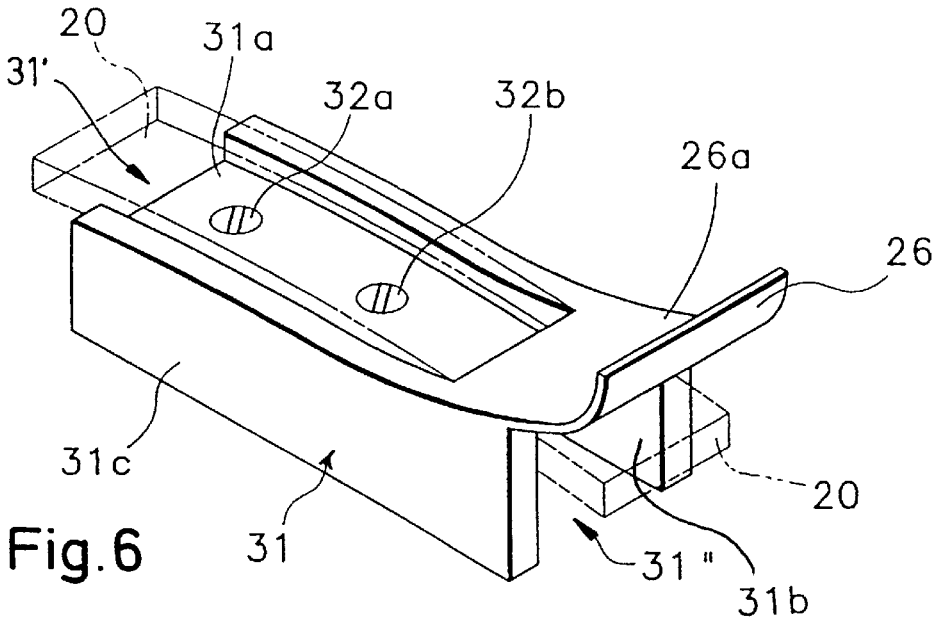
Fig.6
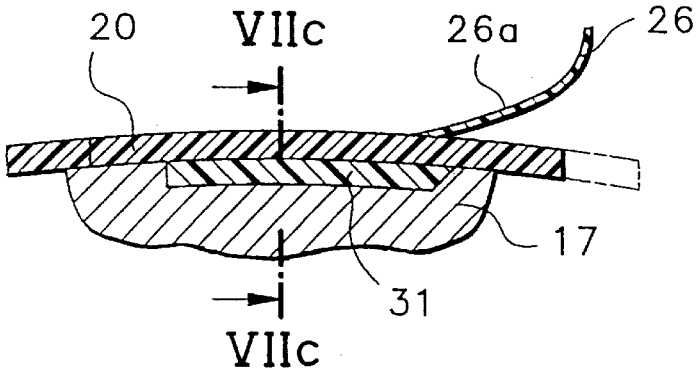
Fig.7a
Fig.7b
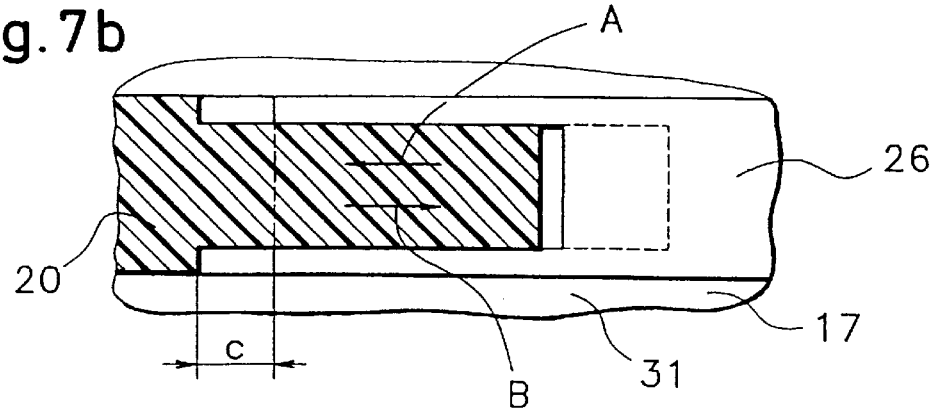

Fig.8c
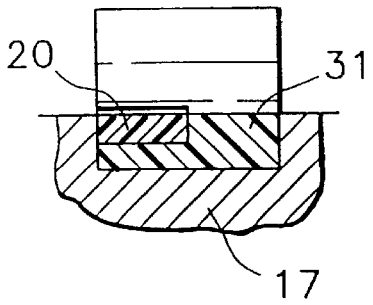
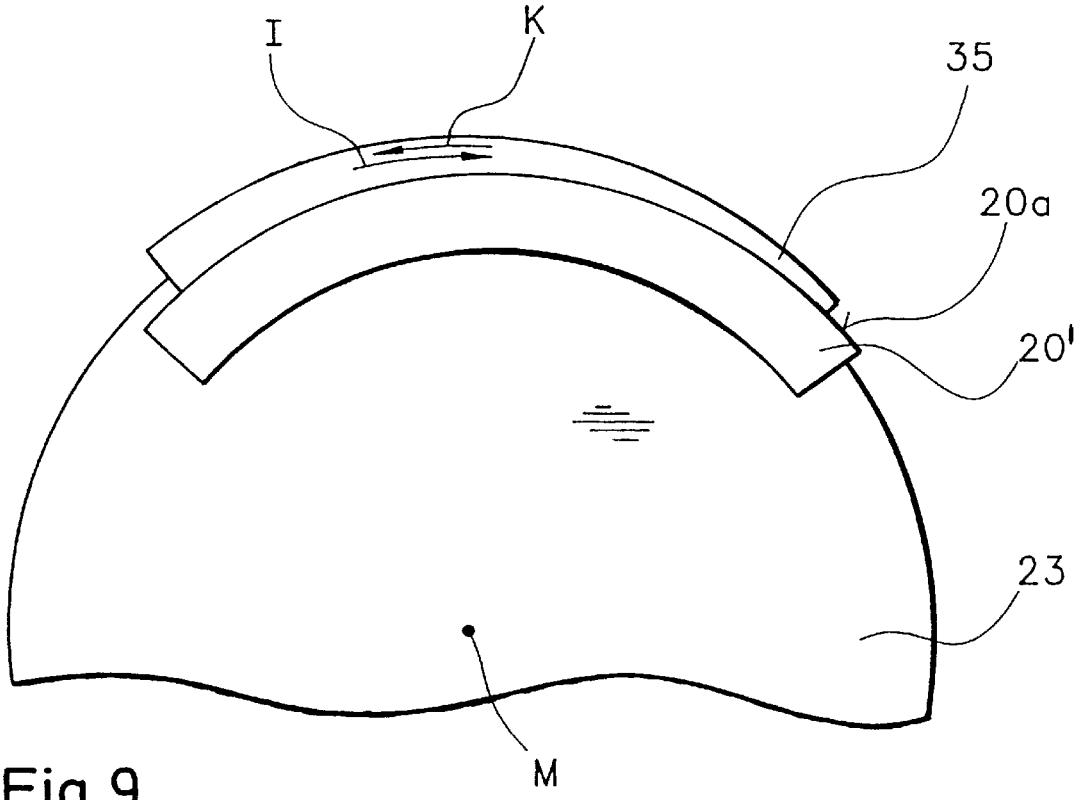
Fig.9

DEVICE FOR A TRAVELING FLATS ASSEMBLY IN A CARDING MACHINE

CROSS REFERENCE TO RELATED APPLICATION

This application claims the priority of German Application No. 198 25 316.8 filed Jun. 5, 1998, which is incorporated herein by reference.

BACKGROUND OF THE INVENTION

This invention relates to a slide guide for a traveling flats assembly for a carding machine. The flats assembly includes clothed flat bars and at least one endless driving element such as a flexible drive belt for advancing the flat bars. The drive belt is trained about end sprockets. The flat bars, with their opposite ends, glide through a work zone on the flexible slide guides arranged on opposite sides of the main carding cylinder and thereafter return along an idling zone situated above the work zone. Each slide guide is composed of three successively arranged parts: an arcuate middle part extending substantially along the entire work zone and having a curvature generally following the curvature of the main carding cylinder and two end parts flanking the middle part and curved around the respective end sprocket to guide the flat bars about the end sprockets and to retain the flat bars in contact with the drive belt. The middle part will also be referred to hereafter as "convex slide guide", whereas the two flanking end parts will also be referred to hereafter as "concave slide guides". The convex slide guide and the two concave slide guides are independent from one another, and the convex slide guide lies on a likewise convexly bent supporting surface of a supporting component (such as a flexible bend).

In practice, the distance between the convex outer face of the convex slide guide, on the one hand, and the concave inner surface of the convex slide guide and the convex outer surface of the supporting surface (flexible bend), on the other hand, is uniform in the circumferential direction. The convex outer and the concave inner surfaces of the convex slide guide, as well as the convex outer surface of the flexible bend are concentric relative to the axis of the main cylinder of the carding machine. The flexible bend is provided with a groove which fixedly receives the convex flexible slide. To vary the distance between the points of the flat bar clothings and the points of the cylinder clothing, for example, because of an increase in the nep number and/or because of a fiber shortening in the carded web, the position of the flexible bend is conventionally varied by means of a plurality of setscrews whereby at the same time, the position of the convex slide guide is changed. As a result, the position of the flat bars together with the flat bar clothing and thus the distance between the clothings is changed as well. Such a new adjustment of the flexible bend involves significant technological outlay. Further, the geometry of the flexible bend depends from the number of setscrews. For performing such an adjustment, lateral carding elements such as drive, suction components and also the flat bars have to be removed and again reassembled after the adjusting operation is completed. During such a work which involves a significant assembly input, the carding machine is at a standstill and thus production is interrupted.

In a known device the convex slide guide is affixed at one of its ends to the flexible bend, whereby the convex slide guide is immobilized. The end of affixation is in the region of the beginning of the convex slide guide as viewed in the direction of motion of the flat bars. The flat bars exert, in the direction of their travel, a pulling force on the convex slide guide which may cause deformations. As a result, the quiet run of the flat bars in the transitional zones between the convex slide guide and the concave slide guides may be interfered with.

SUMMARY OF THE INVENTION

It is an object of the invention to provide an improved device of the above-outlined type from the which the discussed disadvantages are eliminated and which, in particular, improves the form-stability of the convex slide guide and permits a disturbance-free transition of the flat bars between the convex slide guide and the concave slide guides.

This object and others to become apparent as the specification progresses, are accomplished by the invention, according to which, briefly stated, the traveling flats assembly of a carding machine includes first and second end sprockets; an endless belt supported by the first and second end sprockets; a plurality of flat bars arranged in a series along the belt; a coupling arrangement for connecting the flat bars to the belt for being carried by the lower belt flight through a working zone in which the flat bars cooperate with the main carding cylinder of the carding machine and for being carried by the upper belt flight through a return zone; a supporting component having an arcuate supporting surface; a first concave slide guide extending parallel to one part of a circumference of the first end sprocket for guiding and holding the flat bars as they travel about the first end sprocket; a second concave slide guide extending parallel to one part of a circumference of the second end sprocket for guiding and holding the flat bars as they travel about the second end sprocket; and a convex slide guide extending through the work zone and lying on the supporting surface of the supporting component. The convex slide guide has an upper surface on which the flat bars glide. The convex slide guide is longitudinally shiftable relative to the supporting component. The first and second concave slide guides and the convex slide guide are mutually separate components and the convex slide guide has opposite first and second terminal portions passing through respective first and second concave slide guides.

By virtue of the measures according to the invention, even when the convex slide guide is shifted, a smooth transition of the flat bars from the convex slide guide to the concave slide guide may be ensured. By providing the arrangement according to the invention at both ends of the slide guide, a smooth transition of the flat bars from the convex slide guide to the convex slide guide at the beginning of the work zone is also ensured. By providing that the convex slide guide is shiftable in the circumferential direction and, with its terminal portions, passes through the concave slide guides, the convex slide guide may freely yield when exposed to longitudinal tension forces. Furthermore, a manual or motor driven shifting of the convex slide guide is possible during which its upper surface on which the flat bars glide, is shifted radially and yet, an entirely disturbance-free transition of the flat bars to and from the concave slide guide is ensured. In case the convex slide guide is of wedge-shaped configuration as viewed longitudinally, it may, on the side of the transition into the concave slide guide, yield in the vertical direction and thus a thickness difference relative to the stationary concave slide guide may be compensated for.

The invention has the following additional advantageous features:

The convex slide guide is of wedge-shaped configuration and thus the top and bottom surfaces converge toward one another as viewed in one of the circumferential directions.

The component which supports the convex slide guide has a groove in which the convex slide guide, made preferably of a wear-resistant, flexible plastic of low coefficient of friction is received.

The lower oblique surface of the convex slide guide cooperates with a correspondingly inclined supporting surface of the slide guide-supporting component.

The concave slide guides are fixedly attached.

The end of the concave slide guides is situated externally of the working zone of the flat bars.

The end of concave slide guides is situated at the lateral webs of an approximately U-shaped carrier element which is fixedly supported, for example, on the machine frame.

The convex slide guide penetrates the concave slide guide externally of the working zone of the flat bars.

The U-shaped carrier element has two planar lateral walls and a planar bottom wall, and the lateral walls each have an extension.

The convex slide guide projects beyond the end faces of the carrier element.

The convex slide guide is guided by the lateral faces of the carrier element.

The flat bar-supporting slide face of the convex slide guide lies at least partially on the bottom face of the carrier element.

The convex slide guide projects beyond the side walls of the carrier element.

The terminal portions of the convex slide guide are biased towards the end of the respective concave slide guides.

The convex slide guide may be shifted about approximately 100 mm and the radial displacement of the slide guide is—as viewed at the same location—approximately between 0.01 and 0.3 mm.

Underneath the lower surface of the convex slide guide a wedge-shaped slide guide support is arranged which, upon displacement, results in a radial shift of approximately 0.2 to 4 mm.

In a device in which the convex slide guide and the two flanking concave slide guides are constituted by a single, one-piece component, the concave slide guides have a thin wall and are of ribbon shape and are spring-biased at their ends, and further, the convex slide guide is shiftable in the circumferential direction of the supporting surface.

BRIEF DESCRIPTION OF THE DRAWINGS

FIG. 6 is a perspective view of the structure shown in FIG. 5*a*.

FIG. 7*a* is a schematic sectional side elevational view of a further preferred embodiment of the invention.

FIG. 7*b* is a top plan view of the structure shown in FIG. 7*a*.

FIG. 8*c* is a sectional view taken along line VIIIc—VIIIc of FIG. 8*a*.

FIG. 9 is a schematic side elevational view showing a stationary flexible slide guide support and a convex slide guide shiftable thereon.

DESCRIPTION OF THE PREFERRED EMBODIMENTS

Figure 1:
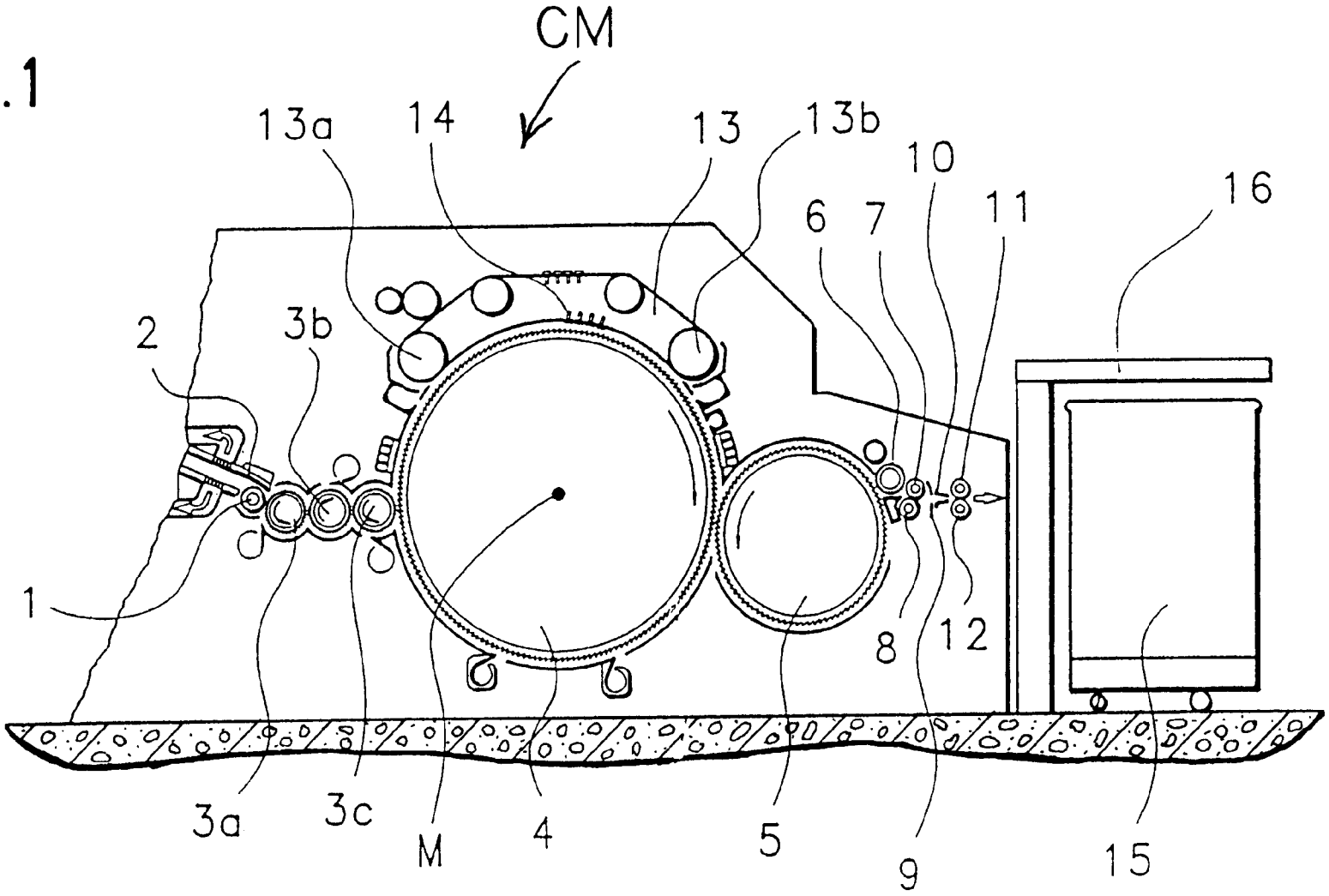
FIG. 1 is a schematic side elevational view of a carding machine adapted to incorporate the invention.

FIG. 1 shows a carding machine CM which may be, for example, an EXACTACARD DK 803 model, manufactured by Trutzschler GmbH & Co. KG, Monchengladbach, Germany. The carding machine CM has a feed roll 1 cooperating with a feed table 2, licker-ins 3*a*, 3*b*, 3*c*, a main carding cylinder 4 having a rotary axis M, a doffer 5, a stripping roll 6, crushing rolls 7, 8, a web guiding element 9, a sliver trumpet 10, calender rolls 11, 12, a traveling flats assembly 13 having flat bars 14, a coiler can 15 and a sliver coiler device 16. The curved arrows drawn into the various rolls show the direction of rotation thereof.

Figure 2:
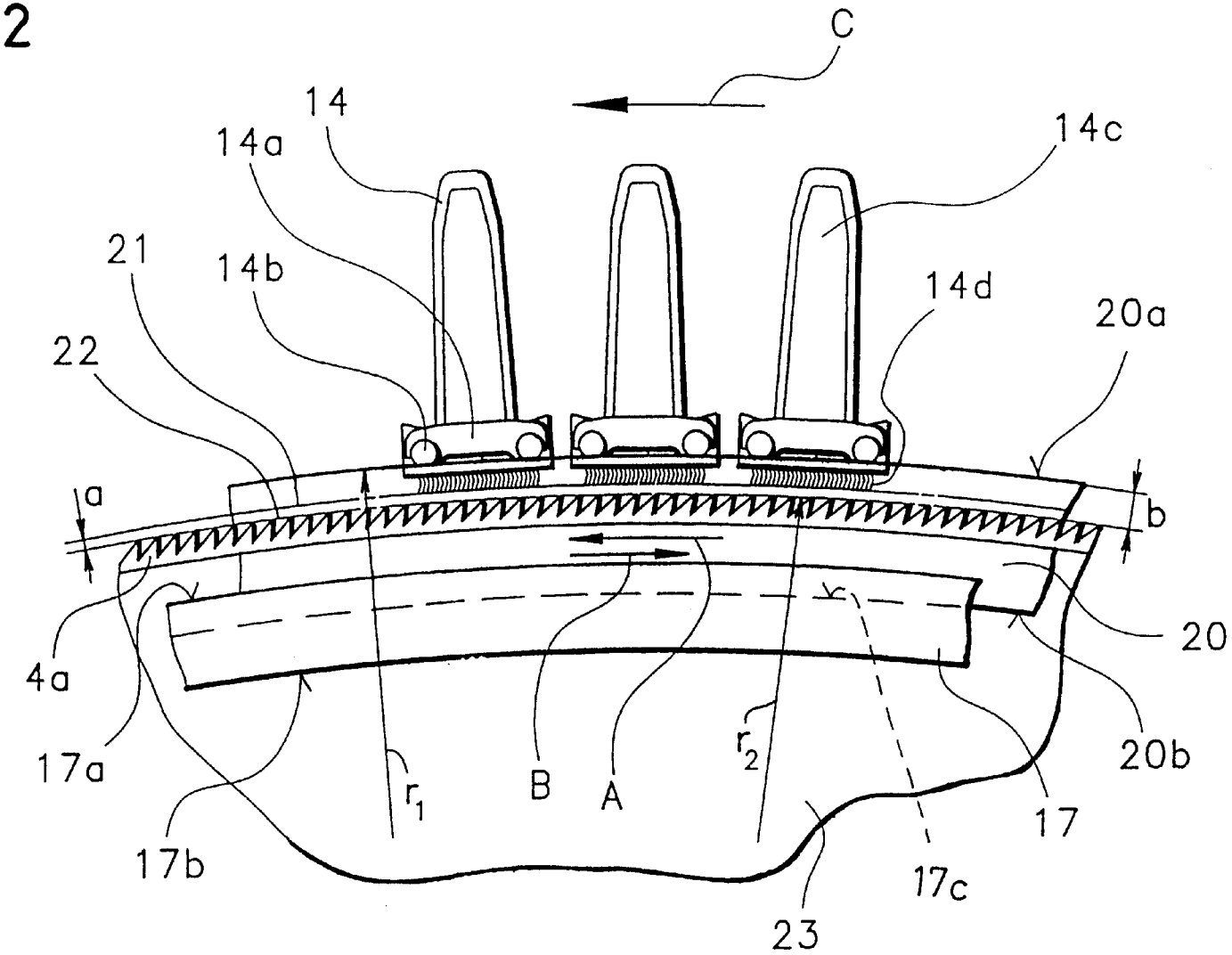
FIG. 2 is a fragmentary schematic side elevational view of the traveling flats assembly of the carding machine.

Turning to FIG. 2, a flexible bend 17 is secured to the machine frame 23 on each side of the carding machine. Each flexible bend 17 has a convex upper surface 17*a* and a concave underside (lower surface) 17*b*. Above the flexible bend 17 an arcuately bent slide guide 20 is disposed which is made of a low-friction material and which has a convex upper surface 20*a* and a concave lower surface 20*b*. The concave lower surface 20*b* lies on the convex upper surface 17*a* and is partially received in a circumferential groove 17*c* provided in the upper surface 17*a* of the flexible bend 17. The slide guide 20 is shiftable with respect to the flexible bend 17 in the direction of the arrows A and B. Such a shifting motion of the slide guide 20 is effected by a displacing device (not shown) which has a drive such as a motor, a gearing or the like. The flat bars 14 have at their lower end a flat bar head 14*a* provided with steel pins 14*b* which slide in the direction of the arrow C on the outer surface (flat bar-supporting surface) 20*a* of the convex slide guide 20. The underface of each flat bar body 14*c* carries a flat bar clothing 14*d*. As viewed along all the flat bars situated in the working zone, the circle on which the clothing points of the flat bars lie is designated at 21. The carding cylinder 4 has a clothing 4*a*, such as a sawtooth clothing and the circle circumscribable about the points of the clothing 4*a* is designated at 22. The radial clearance between the circles 21 and 22 is designated at a and is, for example, 0.20 mm. The distance between the flat bar-supporting surface 20*a* and the circle 22 is designated at b. The surface 20*a* has a radius $r_1$ and the circle 22 has a radius $r_2$. The radii $r_1$ and $r_2$ intersect in the axis M of the main carding cylinder 4.

Figure 3:
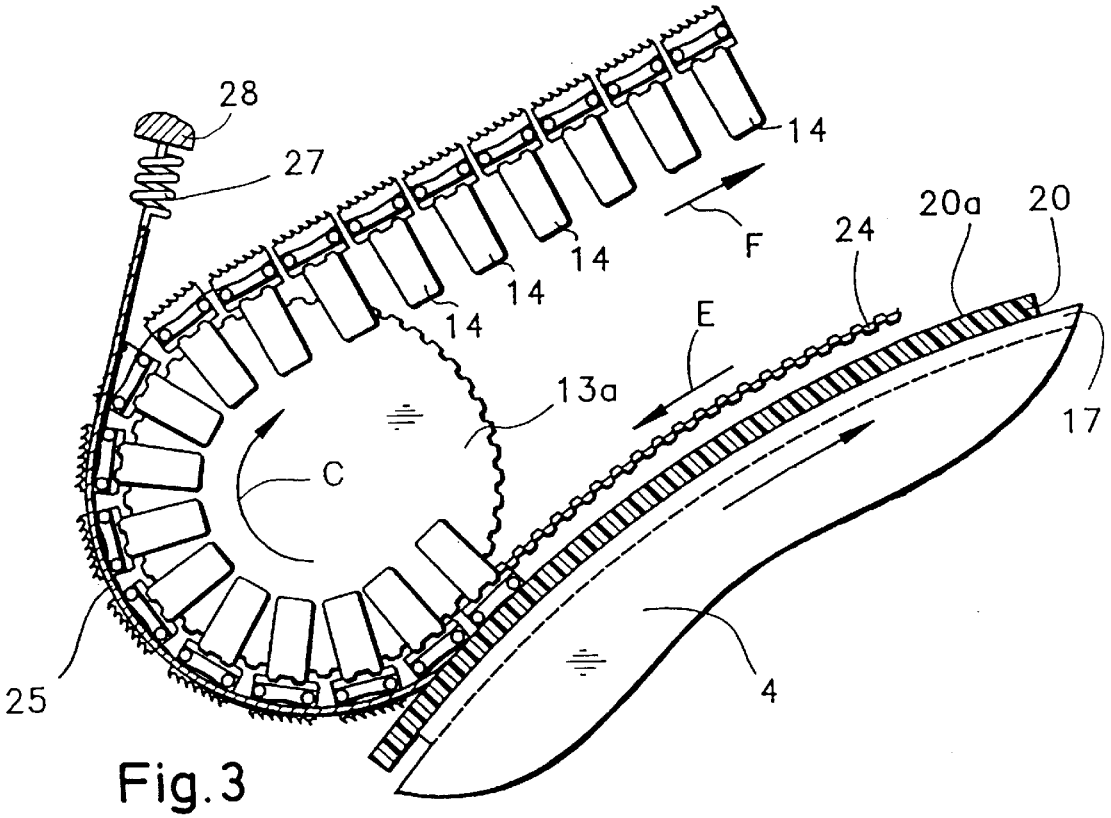
FIG. 3 is a fragmentary schematic side elevational view of other parts of the traveling flats assembly according to the invention.

FIG. 3 shows further details of the traveling flats assembly of FIGS. 1 and 2. An endless flexible belt 24 is provided to carry the flat bars 14 along their endless path of travel, that is, in the working direction E and in the return direction F. The belt 24 is toothed on both faces; the teeth on the inner face of the belt 24 mesh with end sprockets 13*a* and 13*b*, whereas the teeth on the outer face of the belt 24 mesh with complementally formed teeth on each flat bar 14 to thus entrain the flat bars along their endless path. The flat bars 14 glide, with their oppositely oriented pins 14*b*, on the slide face 20*a* of the convex slide guide 20. As the end sprocket 13*a* rotates clockwise as shown by the arrow C, the sprocket 13*a* pulls the lower flight of the toothed belt 24 in the direction of the arrow E. The belt 24 presses the pins 14*b* extending from each flat bar head 14*a* against the convex slide guide surface 20*a*.

Figure 4:
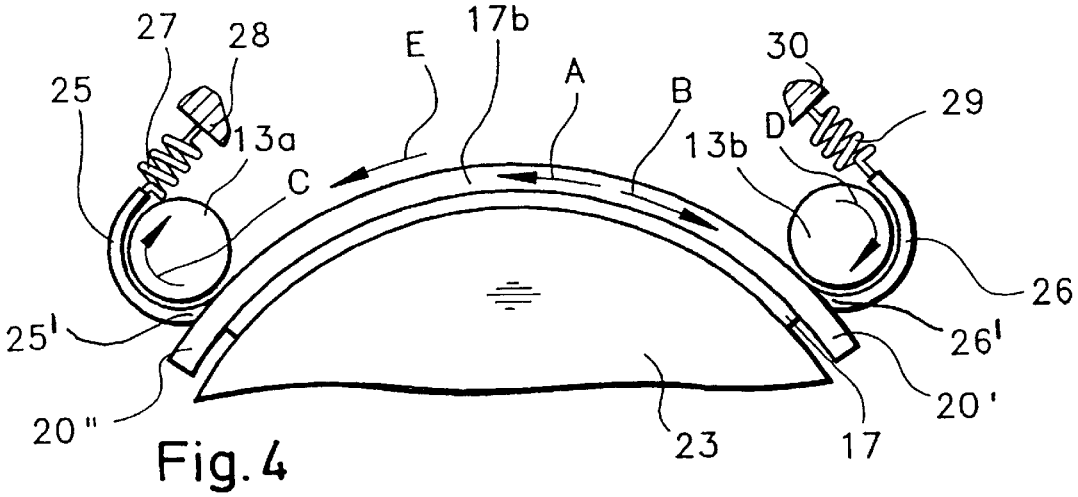
FIG. 4 is a schematic side elevational view of a slide guide assembly according to the invention, composed of a convex slide guide and two flanking concave slide guides, wherein the three components are independent from one another.

Also referring to FIG. 4, the convex slide guide 20 has, on either end, a respective, concave slide guide 25 and 26 which follow the curvature of the respective end sprockets 13*a* and 13*b*. As well seen in FIG. 3, the concave slide guides 25 and 26 hold the flat bars 14 against the respective sprocket 13*a* and 13*b* as the flat bars 14 travel arcuately thereabout. The right-hand sprocket 13*b* rotates clockwise in the direction of the arrow D and pulls the upper flight of the toothed belt 24 in the direction of the arrow F. The convex slide guide 20 is arranged on the flexible bend 17 and is shiftable in the direction of the arrows A, B. The flat bar heads 14*a* lie loosely on the outer face of the upper flight of the belt 24 during their travel in the direction F. The convex slide guide 20 and the two flanking concave slide guides 25 and 26 are independent from one another. The concave slide guides 25 and 26 are affixed to the flexible bend 17 in the region of the respective sprockets 13*a* and 13*b*, as shown in FIG. 6.

According to FIG. 4, at the free end 25' of the concave slide guide 25 one end of a tension spring 27 is attached which, at its other end, is affixed to a stationary support 28. The tension spring 27 is preferably soft to eliminate an interfering effect of the looping pressure by the concave slide guide 25. The same arrangement is provided at the end of the concave slide guide 26 where a tension spring 29 is mounted on a stationary support 30 for exerting a pulling force on the end of the concave slide guide 26. The ends 20' and 20" of the convex slide guide 20 project through the corresponding ends 25' and 26' of the concave slide guides 25 and 26.

Each concave slide guide 25 and 26 is supported by a respective carrier element. The carrier element associated with the concave slide guide 26 will now be described in conjunction with FIGS. 5*a*, 5*b*, 5*c* and 6. The carrier element associated with the concave slide guide 25 may be structured identically to the carrier element supporting the concave slide guide 26.

Figure 5A:
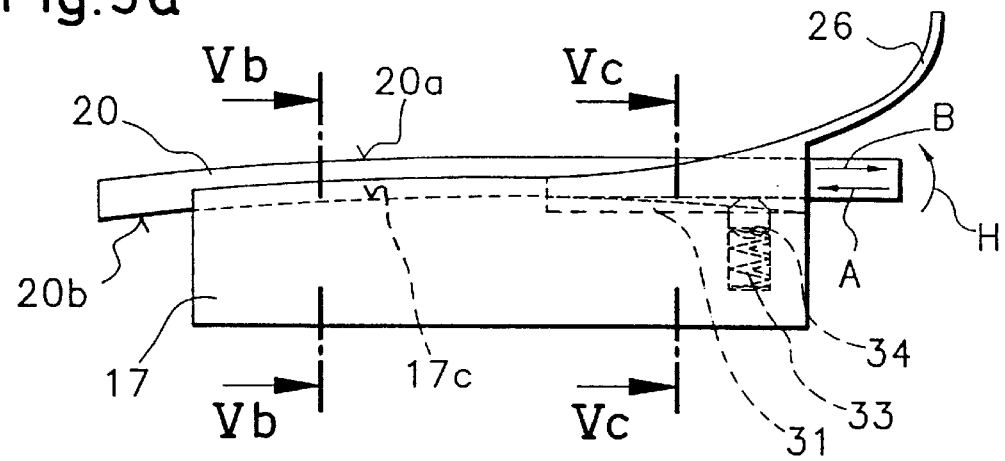
FIG. 5*a* is a fragmentary schematic side elevational view of a preferred embodiment of the invention.
Figure 5B:
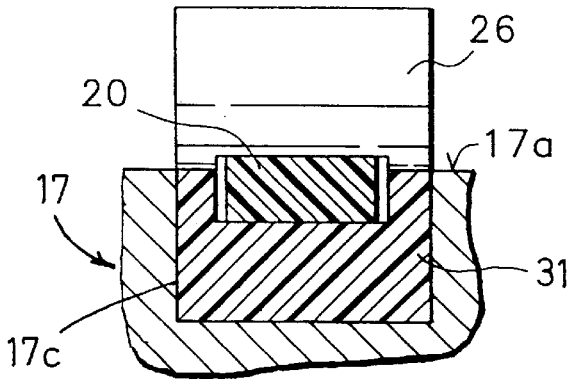
FIG. 5*b* is a sectional view taken along line Vb—Vb of FIG. 5*a*.
Figure 5C:
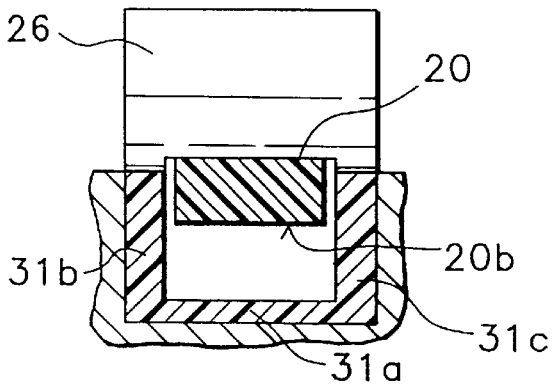
FIG. 5*c* is a sectional view taken along line Vc—Vc of FIG. 5*a*.

The carrier element 31 and the concave slide guide 26 constitute a one-piece plastic component. The carrier element 31 is attached by screws 32*a*, 32*b* to the flexible bend 17. The carrier element 31 is cross-sectionally U-shaped and has a bottom face 31*a* and two side walls 31*b* and 31*c* extending perpendicularly to the bottom face 31*a*. The carrier element is thus open at its opposite ends. In the region of the end 31" the transitional part from the carrier element 31 to the concave slide guide 26 forms a cover portion. An aperture of the bottom face 31*a* of the carrier element 31 faces the cover portion. The side walls 31*b*, 31*c* rise in the direction of the concave slide guide 26 whereby the upper edge faces of the side walls 31*b*, 31*c* and the slide faces of the concave slide guide 26 have a smooth, seamless transition into one another. The convex slide guide 20 is, as shown in FIGS. 5*a* and 5*b*, partially received along its length in the groove 17*c* of the flexible bend 17, so that an upper longitudinal part of the convex slide guide projects beyond the top face 17*a* of the flexible bend 17. Further, one part of the convex slide guide 20 is situated in the inner space of the carrier element 31 while another part projects beyond the upper edge faces of the side walls 31*b* and 31*c*. The convex slide guide 20 extends through one terminal opening 31' of the carrier element 31 and projects outwardly therefrom through the other terminal opening 31", that is, the convex slide guide 20 projects beyond the carrier element 31 at both end faces thereof. In the inner space of the carrier element 31 the convex slide guide 20 is arranged with a clearance from the bottom wall 31*a* as well as from side walls 31*b*, 31*c*. The convex slide guide 20 is pre-tensioned and pressed by the pressing force of the flat bar heads 14*a* into the groove 17*c*. The terminal region of the convex slide guide 20 extending from the inlet opening 31' into the carrier element 31 is approximately linear. In this manner a torque is generated in the direction of the arrow H (FIG. 5*a*) whereby the terminal region of the convex slide guide 20 is tensioned towards the concave slide guide 26. Such a tension may be reinforced by a separate torque-exerting element, for example, a ball 34 loaded by a spring 33 so that the convex slide guide 20 lies against the edge of the concave slide guide 26; in this manner soiling is avoided. As the flat bar heads 14*a* press the convex slide guide 20 above the carrier element 31 against the above-discussed tension force towards the bottom face 31*a*, the slide face 20*a* is flush with the two free upper faces of the side walls 31*b*, 31*c*, so that the flat bar heads 14*a*, that is, the steel pins 14*d*, lie on the slide face 20*a* and on the upper faces of the lateral walls 31*b*, 31*c*. Since the upper face of the side walls 31*b*, 31*c* have a seamless transition to the concave slide guide 26, a disturbance-free, smooth transition of the flat bars 14*a* from the slide face 26*a* of the concave slide guide 26 to the slide face 20*a* of the convex slide guide 20 may be obtained.

Figure 7C:
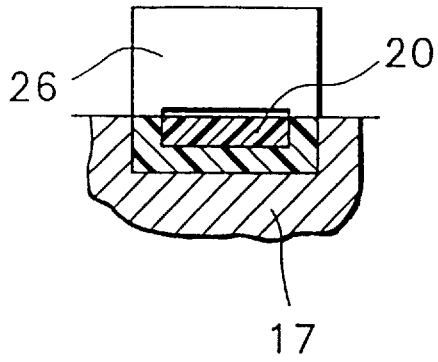
FIG. 7*c* is a sectional view taken along line VIIc—VIIc of FIG. 7*a*.

In the construction shown in FIGS. 7*a*, 7*b* and 7*c* the flexible bend 17 is wider than the concave slide guide 26. The convex slide guide 20 is wider externally of the carrier element 31 than its part which extends inside the carrier element 31. The convex slide guide 20 is shiftable in the direction of the arrows A, B to an extent designated at c.

Figure 8A:
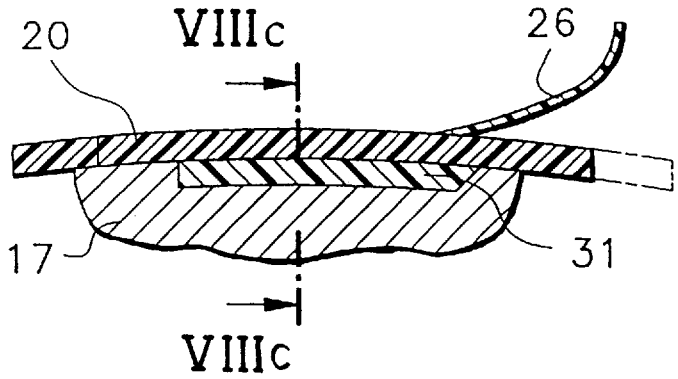
FIG. 8*a* is a sectional side elevational view of yet another preferred embodiment of the invention.
Figure 8B:
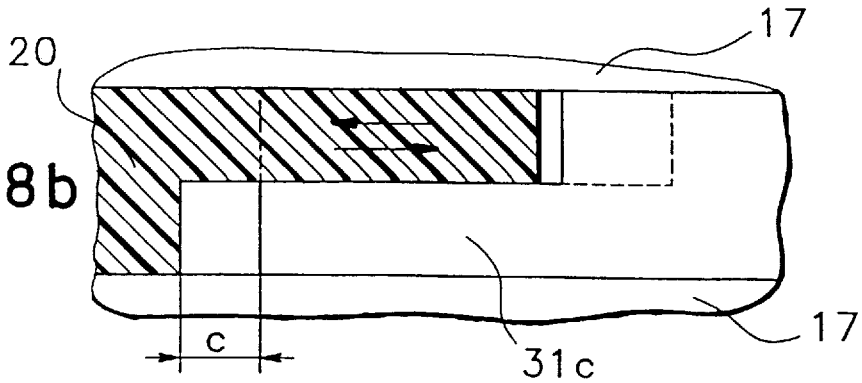
FIG. 8*b* is a top plan view of the structure shown in FIG. 8*a*.

FIGS. 8*a*, 8*b* and 8*c* illustrate an embodiment wherein the carrier element 31 has one side wall 31*c*.

FIG. 9 schematically illustrates the rigid side plate 23 of the machine frame and a slide guide support 20' which has a substantial radial thickness and which is affixed in an arcuate groove 17*c* (FIG. 2) of the side plate 23. The center of curvature of the bottom of the groove 17*c* is disposed eccentrically to the carding cylinder axis M. The upper and lower arcuate surfaces of the slide guide support 20' extend parallel to one another. On the outer face 20*a* of the slide guide support a slide guide 35 is arranged which is of circumferentially wedge-shaped configuration and which may be shifted in the direction of the arrows I, K. The slide guide 35 has a smaller radial thickness than the slide guide support 20' and has a small gradient which is approximately 1:250=0.2 mm given a shift of 50 mm in the direction I or K. Such a displacement serves for a fine adjustment. The terminal zones of the slide guide (convex slide guide) 35 project through the concave slide guides 25, 26 as described earlier. The radially relatively thick slide guide support 20' serves for an equalization of manufacturing tolerances and different heights of clothings and replaces the conventional flexible bend.

Figure 10:
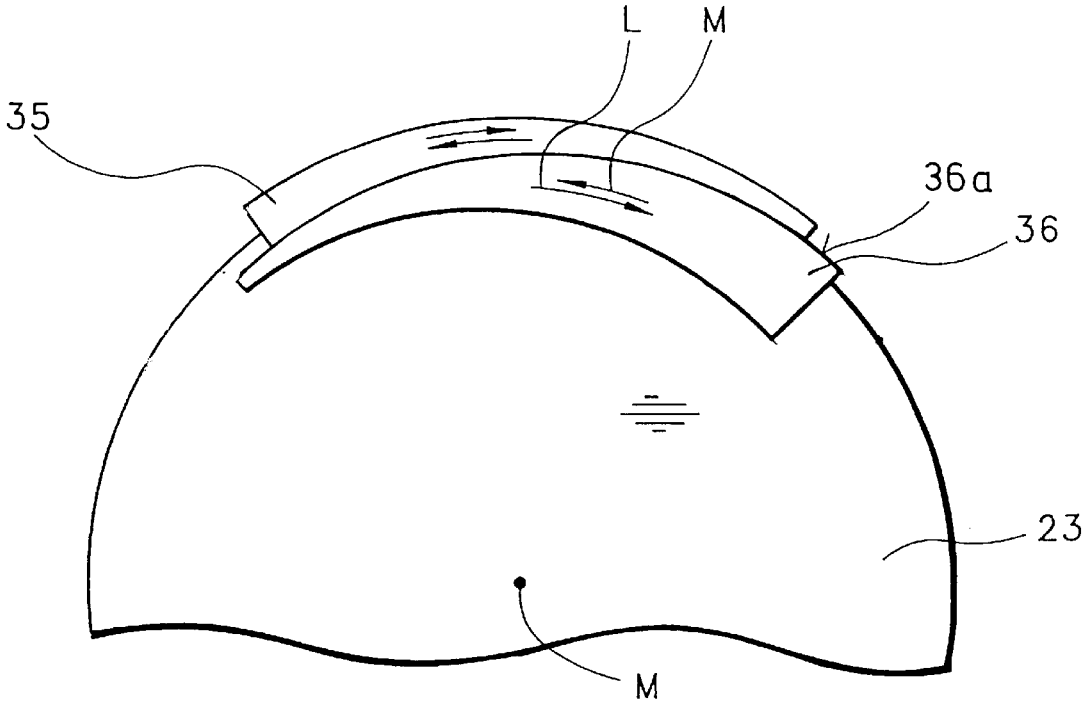
FIG. 10 is a schematic side elevational view showing a shiftable flexible slide guide support and a convex slide guide shiftable thereon.

In FIG. 10 a radially relatively thick wedge-shaped slide guide support 36 is provided which has a large slope equalling approximately 3.3 mm for a 50 mm shift. The slide guide support 36 which replaces the conventional flexible bend is displaceable in a groove of the side plate 23 in the direction of the arrows L, M and serves for compensating for manufacturing tolerances and unlike clothing heights. On the outer (upper) surface 36*a* of the slide guide support 36 a wedge-shaped slide guide 35 is arranged, similarly to FIG. 9. The slopes of the slide guide support 36 and the slide guide 35 are oriented opposite to one another. The terminal portions of the slide guide support 36 and the slide guide 35 project through the concave slide guides 25 and 26.

It will be understood that the above description of the present invention is susceptible to various modifications, changes and adaptations, and the same are intended to be comprehended within the meaning and range of equivalents of the appended claims.

What is claimed is:

1. A traveling flats assembly forming part of a carding machine and cooperating with a main carding cylinder thereof; said assembly comprising (a) first and second end sprockets;

(b) an endless belt trained about and supported by said first and second end sprockets; said endless belt having upper and lower flights;

(c) a plurality of flat bars arranged in a series along the belt;

(d) coupling means for connecting said flat bars to said belt for being carried by said lower flight through a working zone in which the flat bars cooperate with the main carding cylinder and for being carried by said upper flight through a return zone;

(e) a supporting component having an arcuate supporting surface;

(f) a first concave slide guide extending parallel to one part of a circumference of said first end sprocket for guiding and holding said flat bars as they travel about said first end sprocket;

(g) a second concave slide guide extending parallel to one part of a circumference of said second end sprocket for guiding and holding said flat bars as they travel about said second end sprocket; and (h) a convex slide guide extending through said work zone and lying on said supporting surface of said supporting component; said convex slide guide having an upper, flat bar-supporting surface on which said flat bars are supported for a gliding motion; said convex slide guide being longitudinally shiftable relative to said supporting surface of said supporting component; said first and second concave slide guides and said convex slide guide being mutually separate components; said convex slide guide having opposite first and second terminal portions passing through respective said first and second concave slide guides.

2. The traveling flats assembly as defined in claim 1, wherein said first and second concave slide guides are fixedly supported.

3. The traveling flats assembly as defined in claim 1, wherein said first and second concave slide guides each having an end situated externally of said work zone.

4. The traveling flats assembly as defined in claim 1, wherein said first and second terminal portions of said convex slide guide pass through respective said first and second concave slide guides externally of said work zone.

5. The traveling flats assembly as defined in claim 1, wherein said first and second concave slide guides have respective ends situated adjacent respective said first and second terminal portions of said convex slide guide; further comprising means for pre-tensioning said convex slide guide against respective said first and second concave slide guides.

6. The traveling flats assembly as defined in claim 1, further comprising a carrier element arranged at said first terminal portion of said convex slide guide and forming a one-piece component with said first concave slide guide; said carrier element having a bottom wall and a side wall rising from said bottom wall generally perpendicularly thereto; said first terminal portion of said convex slide guide being disposed on said bottom wall and being guided by said side wall.

7. The traveling flats assembly as defined in claim 1, further comprising a carrier element arranged at said first terminal portion of said convex slide guide and forming a one-piece component with said first concave slide guide; said carrier element having a bottom wall and opposite side walls rising from said bottom wall generally perpendicularly thereto; said first terminal portion of said convex slide guide being disposed on said bottom wall and being guided by said side walls.

8. The traveling flats assembly as defined in claim 7, wherein said convex slide guide lies on said bottom of said carrier element and projects upwardly beyond the top edges of said side walls whereby said upper surface of said convex slide guide lies in a plane above said top edges; said convex slide guide being guided by said side walls.

9. The traveling flats assembly as defined in claim 7, wherein said carrier element is immovably supported.

10. The traveling flats assembly as defined in claim 7, wherein said bottom and said side walls are planar.

11. The traveling flats assembly as defined in claim 7, further comprising securing means for fixedly attaching said carrier element to said supporting component.

12. The traveling flats assembly as defined in claim 7, wherein each said side wall has a top edge face; said upper surface of said convex slide guide along said first terminal portion thereof is situated at a higher level than the top edge faces of said side walls; said first concave slide guide has a flat bar-supporting surface having a smooth, continuous transition from the top edge faces of said side walls; said first terminal portion of said convex slide guide passing below said first concave slide guide, whereby a smooth, continuous transition between said flat bar-supporting surface of said convex slide guide and said flat bar-supporting surface of said first concave slide guide is effected by said top edge faces for said flat bars during travel thereof.

13. The traveling flats assembly as defined in claim 12, wherein a first part of said first terminal portion of said convex slide guide lies on said bottom wall; further comprising force-exerting means for urging a second part of said first terminal portion of said convex slide guide against an underside of said first concave slide guide.

14. The traveling flats assembly as defined in claim 13, wherein said force exerting means comprises a spring disposed between said supporting component and said convex slide guide.

15. The traveling flats assembly as defined in claim 1, wherein said convex slide guide is wedge-shaped as viewed longitudinally, whereby a shifting of said convex slide guide effects a radial displacement of said supporting surface of said convex slide guide as viewed at any location therealong.

* * * * *